United States Patent [19]

Chenet et al.

[11] 4,411,233

[45] Oct. 25, 1983

[54] CARBURATION DEVICES FOR INTERNAL COMBUSTION ENGINES

[75] Inventors: Jacques Chenet, Sevres; Michel Pierlot, Le Pecq, both of France

[73] Assignee: Societe Industrielle de Brevets et d'Etudes S.I.B.E., Neuilly-sur-Seine, France

[21] Appl. No.: 169,843

[22] Filed: Jul. 17, 1980

[51] Int. Cl.[3] ..... F02M 7/12

[52] U.S. Cl. ..... 123/439; 123/438; 123/443; 123/494; 261/44 F; 261/50 A; 261/DIG. 74; 261/DIG. 82

[58] Field of Search ..... 123/439, 438, 443, 472, 123/478, 490, 483, 484, 494; 261/44 F, 50 A, DIG. 74, DIG. 82

[56] References Cited

U.S. PATENT DOCUMENTS

| | | | |
|---|---|---|---|
| 2,084,489 | 6/1937 | Hess | 261/50 A |
| 2,936,744 | 5/1960 | Paule et al. | 123/484 |
| 3,051,152 | 8/1962 | Paule et al. | 123/483 |
| 3,931,814 | 1/1976 | Rivere | 123/438 |
| 3,967,608 | 7/1976 | Mennesson | 261/50 A |
| 4,034,029 | 7/1977 | Tipton | 261/44 F |
| 4,046,118 | 9/1977 | Aono | 123/438 |
| 4,089,308 | 5/1978 | Pierlot | 123/438 |
| 4,217,863 | 8/1980 | Ezoe | 123/494 |

FOREIGN PATENT DOCUMENTS

| | | | |
|---|---|---|---|
| 2339826 | 2/1975 | Fed. Rep. of Germany | 123/494 |
| 1445849 | 8/1976 | United Kingdom | 123/438 |
| 2028431 | 3/1980 | United Kingdom | 261/50 A |
| 2037893 | 7/1980 | United Kingdom | 261/44 F |

*Primary Examiner*—Charles J. Myhre
*Assistant Examiner*—Andrew M. Dolinar
*Attorney, Agent, or Firm*—John T. Synnestvedt; Richard D. Weber

[57] ABSTRACT

A constant depression carburettor has an auxiliary throttle member associated with a sensor which delivers a signal representative of the position of the auxiliary throttle member. A solenoid valve is actuated by pulses received from a control circuit which receives input signals from sensor. The solenoid valve meters the fuel delivered to the intake passage via a discharge orifice located at the throat of a venturi limited by a swelling of the intake passage and by the throttle.

4 Claims, 2 Drawing Figures

CARBURATION DEVICES FOR INTERNAL COMBUSTION ENGINES

BACKGROUND AND SUMMARY OF THE INVENTION

The invention relates to a carburation device for an internal combustion engine of the type which comprises, in its intake passage, upstream of an operator actuated main throttle member, an auxiliary throttle member which opens automatically and progressively as the air flow passing through said passage increases and which controls a mixture control device metering the fuel flow drawn into a discharge orifice in the passage from a float chamber, said mixture control device comprising a solenoid or electromagnetic valve placed between the float chamber and the orifice and controlled by periodic electrical pulses supplied by an electronic circuit which receives an input signal from an electric component, such as potentiometer, controlled by the movements of the auxiliary throttle member so that the fuel flow per unit of time depends on the position of the auxiliary throttle member.

Carburation devices of the above type are described in U.K Specification Nos. 1 505 438 and 1 505 439, wherein the discharge orifice is placed downstream of the main throttle member and is therefore subjected to a degree of vacuum which varies in a large range during operation of the engine, which renders correction means necessary.

On the other hand, carburettors of the so-called "constant depression" type are known which have a fuel discharge orifice placed substantially at the throat of a venturi formed by a constricted part of the intake passage and the auxiliary throttle member (UK Pat. No. 1 469 590 and U.S. Pat. No. 3,889,552 (Bauer)).

However, fuel flow control in such carburettors of conventional design is by a mechanical linkage between the auxiliary throttle and the movable member (generally a needle) of a variable jet. That construction has a number of disadvantages:

the mechanical coupling between the auxiliary throttle member, forming an air flow meter, and the variable jet involves a linkage whose initial adjustment is difficult and resistance to wear is limited, in which friction must be as low as possible;

there is generally no sufficient space available for locating an enrichment throttle valve upstream of the fuel delivery jet and consequently it is not possible to use a conventional starting device of the type used on carburettors of fixed geometry;

the annular passage defined by the jet and a movable needle has a wet surface much larger than that of a conventional fixed jet; the flow is consequently much more sensitive to the viscosity of the fuel, which makes the device very sensitive to temperature;

any lack of concentricity between the needle and the jet causes the equivalent hydraulic radius to vary considerably and consequently considerably affects the flow; if a guide is used for centring the needle, it increases the friction forces and complicates the construction.

It is an object of the invention to provide an improved carburation device in which the respective deficiencies of the two above kinds of carburettors are cured to a substantial extent and which is simple in construction and efficient in operation whatever the load and running speed of the engine.

For that purpose, the discharge orifice of a carburation device of the type set forth is located at the throat of the variable venturi, which is typically defined by a bulged portion of the intake passage wall and an auxiliary throttle formed as a streamlined oscillating vane. The solenoid valve is opened at least once per revolution of the engine for a variable time duration and preferably with a proper phase with respect to the dead centers of the engine pistons. Proper timing of fuel delivery once per turn may compensate for the inherent unbalance of fuel distribution between the engine combustion chambers in a 4-cylinder engine.

The solenoid valve will be of the type having a full opening condition and a zero or reduced opening condition and will assume one of the conditions at rest and the other during the period of each energizing electric pulse.

SHORT DESCRIPTION OF THE DRAWINGS

DETAILED DESCRIPTION OF A PARTICULAR EMBODIMENT

Figure 1:
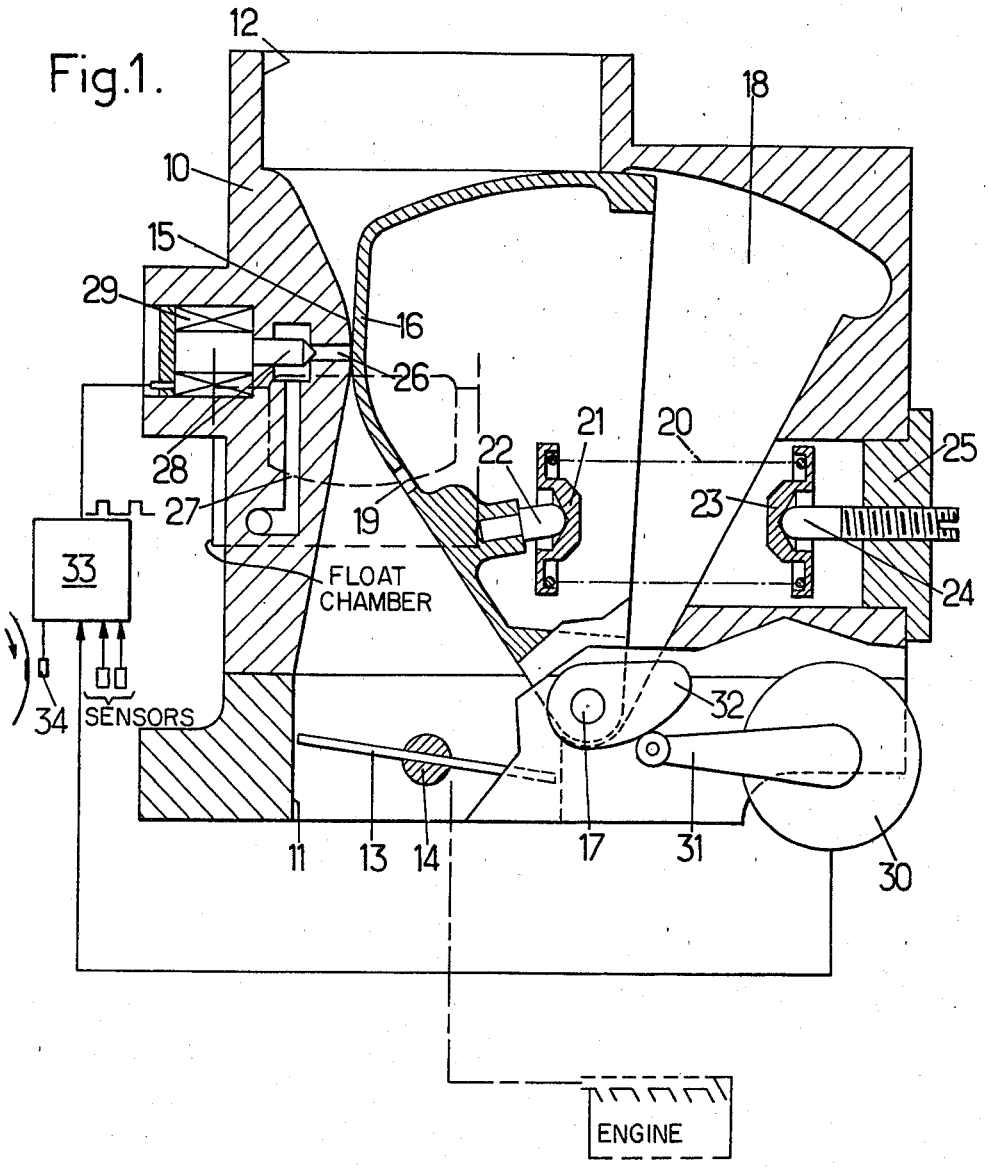
FIG. 1 shows a carburation device according to an embodiment of the invention, in cross-section along a vertical plane passing through the axis of the intake passage, the parts being in the position which they assume when the engine equipped with the device is at rest.

The carburation device comprises a body 10 in which is provided an intake passage 11 having an air inlet 12 fitted with an air filter (not shown). In the intake passage 11 is placed a main throttle member actuatable by an operator, formed by a butterfly valve 13 carried by a spindle 14. Upstream of the main throttle member 13, a venturi is formed by a swelling 15 of the body and an auxiliary throttle member 16. Member 16 is formed by a shutter rotatable about a pin 17 parallel to axis 14 and placed at the lower end of member 16. The auxiliary throttle member 16 is capable of moving between a rest position, in which it is shown in FIG. 1, where it rests on swelling 15, and a full opening position in which it rests on the bottom of a chamber 18 provided in body 10 of the carburettor. The auxiliary throttle member slides in its movement over flanges of the chamber, so as to minimize leaks between chamber 18 and the part of the intake passage situated upstream of the auxiliary throttle member. The chamber is connected, for example by a hole 19 formed in the auxiliary throttle member 16, to the part of the intake passage situated between members 16 and 13 so as to be at the same pressure.

A resilient return system biases the auxiliary throttle member toward the position shown in the figure. It comprises a spring 20, one end of which bears on a cup 21 in abutment against a sutd 22 fixed to the auxiliary throttle member 16. The other end of spring 20 is housed in a cup 23 bearing on the end of a screw 24 adjustable in a plug 25 fixed to body 10. The bearing surfaces for the cups comprise a cone and a ball to allow the cups to orientate face to face.

The carburettor is provided with a metering member for metering the fuel flow drawn in from a float chamber (not shown) towards a discharge orifice in the intake passage 11. This discharge orifice 26 is provided in the swelling 15, substantially at the throat of the venturi, i.e. at the position where the flow cross-sectional area offered to the air is the smallest. The fuel control member is located between the discharge orifice 26 and a fuel feed channel 27 from the float chamber (not shown).

In conventional carburettors of the so-called constant depression type, the fuel control member is a needle mechanically associated with the auxiliary throttle member. According to the invention, the metering member comprises a solenoid valve. In the embodiment shown in the figure, the solenoid valve comprises a closure member 28 which, at rest, is applied on a seat provided at the entry to orifice 26 so as to close the latter. The valve comprises an electromagnet or coil 29 which, when energized, brings and holds needle 28 in the fully opened position. The electromagnet is controlled by an electronic circuit 33 supplying rectangular pulses of variable duty ratio. Circuit 33 is provided with an input sensor supplying electric information representative of the angular position of the auxiliary throttle member 16. The sensor is for example a potentiometer 30 whose arm 31 bears on a cam 32, as in one of the embodiments described in U.K. Patent Specification No. 1,505,439. The signal supplied by potentiometer 30 is applied to circuit 33.

An additional sensor 34 associated with the flywheel 35 or the distributor of the engine, which may be of any conventional type, delivers a signal having a predetermined time phase relation with the dead centers of the engine pistons and triggers circuit 33 which in response delivers an electric signal whose duration is controlled by the signal from potentiometer 30. Circuit 33 may also be conventional and for instance include an amplifier and a univibrator whose time constant is controlled by potentiometer 30.

Theoretically, it would be advisable to open the solenoid valve before each opening of an intake valve. In a 4-cylinder engine, that would require opening twice per turn of the crankshaft. This is hardly possible due to the inertia and response time of a solenoid valve.

Applicants have found that fuel delivery once per turn is not only possible, but even may be of advantage if properly timed with respect to opening of the intake valves in an engine having at least one group of four cylinders. In such an engine, due to the geometry of the intake passage and manifold, the 1st and 4th cylinders inherently receive a mixture which is leaner than that delivered to the 2nd and 3rd cylinders, or the reverse, when fuel flows continuously into the intake passage. That unbalance is compensated by delivering fuel during the time period which elapses after the intake valves of cylinders 2 and 3 (or cylinders 1 and 4, depending on the engine) have closed and before the intake valves of cylinders 1 and 4 (or 2 and 3) open. Refering to FIG. 2, the intake valve of a cylinder opens at angle $\alpha_1$; if that cylinder inherently receives a leaner mixture due to the geometry of the manifold, then solenoid valve 28 will be actuated into open condition before that opening and will remain open during a time period represented by an angle which may vary from a minimum value $A_1$ (during idling) and a maximum value $A_2$ (under full load). The intake valve of the next cylinder to intake fuel will open a half-turn later, i.e. for an angle $\alpha+180°$.

Figure 2:
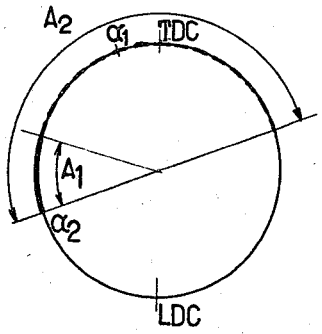
FIG. 2 is a diagram illustrating timing of fuel delivery.

As illustrated in FIG. 2 the fuel delivery is always initiated for the same angle $\alpha_2$. However, the circuit may also be designed for the delivery to end at a predetermined angle or for the delivery to be substantially symetrical with respect to a predetermined angular location.

As an example, in a typical carburation device in which the air flow varies in a ratio of 35/1 and the pressure variation at the throat is in a ratio of about 4/1, angles $A_1$ and $A_2$ wll correspond to duty ratios of 5% and 85% respectively.

The device operates as follows: when the engine is running, auxiliary throttle member 16 assumes a position representative of the air flow which passes through the carburettor; a degree of vacuum (typically 10 to 40 mbar if spring 20 is suitably selected) prevails in the passage at the throat of the venturi. From the signal supplied by potentiometer 30, circuit 33 elaborates an output signal consisting of square pulses whose duty ratio is a function of the degree of opening of the auxiliary throttle member and maintains the air/fuel ratio of the mixture substantially constant.

The device which has just been described may be provided with additional components so as to adapt the richness and the flow of the mixture supplied to the engine to particular operating conditions (particularly starting up, cold running, acceleration and full load). Then, additional sensors are provided for supplying signals representative of such conditions to the electronic circuit, programmed so as to adjust the duty ratio or aperture ratio of the electromagnetic valve. Thus all functions may be fulfilled by one valve.

Numerous modifications of the design are possible: instead of an electric component supplying an analog signal, a digital sensor responsive to the position of the auxiliary throttle member 16 may be used for easier subsequent processing of the data.

We claim:

1. A carburetion device for a four cylinder internal combustion engine having intake and exhaust valves, of the type wherein a couple of cylinders inherently receive a fuel/air mixture leaner than the other couple, said device comprising:

an intake passage, an operator operated main throttle in said passage, an auxiliary throttle located in said passage upstream of said main throttle and which opens automatically and progressively as the air flow through said passage increases, a fuel flow circuit extending from a float chamber to a discharge orifice, opening into the intake passage substantially at the throat of a venturi formed by a constricted part of the passage and by said auxiliary throttle member, and fuel/air mixture control means having a solenoid valve located on said fuel flow circuit, electrical means operatively associated with the auxiliary throttle for providing a signal depending on the position of said auxiliary throttle and electronic circuit means connected to receive said signal and constructed to provide one actuating pulse to said solenoid valve per revolution of the engine at times selected for the solenoid valve to open before opening of an intake valve of a cylinder inherently receiving a leaner fuel mixture and to meter the duty ratio of said pulses responsive to said signal.

2. A device according to claim 1, wherein the solenoid valve is of a type having a full opening condition and a zero opening condition and assumes one condition when de-energized and the other condition when energized by an electric pulse supplied by said circuit.

3. A device according to claim 2, wherein said electrical means associated with the auxiliary throttle is a digital encoder.

4. A device according to claim 1, further comprising sensors for providing signals representative of engine operating parameters other than the position of the auxiliary throttle, wherein the electronic circuit receives control signals from said sensors, so as to adjust the air/fuel ratio and the amount of mixture supplied to the engine during starting up, cold running, acceleration and full load phases.

* * * * *